US006118962A

United States Patent [19]

Casper et al.

[11] Patent Number: 6,118,962

[45] Date of Patent: Sep. 12, 2000

[54] AUTOMATIC CAMMING OF A DEVELOPER MODULE

[75] Inventors: Cindy L. Casper, Marion; Richard P. Schell, Webster; John L. Howard, Rochester, all of N.Y.

[73] Assignee: Xerox Corporation, Stamford, Conn.

[21] Appl. No.: 09/318,954

[22] Filed: May 26, 1999

[51] Int. Cl.[7] ..... G03G 15/04

[52] U.S. Cl. ..... 399/119

[58] Field of Search ..... 399/93, 107, 108, 399/110, 111, 113, 115–117, 119–121, 123–125

[56] References Cited

U.S. PATENT DOCUMENTS

| | | | |
|---|---|---|---|
| 5,119,134 | 6/1992 | Haneda et al. | 355/212 |
| 5,126,789 | 6/1992 | Fukuchi et al. | 355/200 |
| 5,398,098 | 3/1995 | Fukunaga et al. | 355/200 |
| 5,485,244 | 1/1996 | Gotoda et al. | 355/200 |
| 5,666,608 | 9/1997 | Christensen | 399/176 |
| 5,749,027 | 5/1998 | Ikemoto et al. | 399/113 |
| 5,774,766 | 6/1998 | Karakama et al. | 399/111 |
| 5,787,322 | 7/1998 | Sass et al. | 399/110 |
| 5,809,375 | 9/1998 | Owens, Jr. et al. | 399/111 |
| 5,819,139 | 10/1998 | Harlan et al. | 399/110 |
| 5,862,441 | 1/1999 | Ohata | 399/119 |
| 5,953,560 | 9/1999 | Numagami et al. | 399/111 |

*Primary Examiner*—Arthur T. Grimley
*Assistant Examiner*—Hoan Tran
*Attorney, Agent, or Firm*—Andrew D. Ryan

[57] ABSTRACT

A mechanism for use in a printing machine having a cover for covering a portion of the printing machine is provided. The mechanism is operably associated with the cover and with the portion of the printing machine. The mechanism is adapted so as to move the portion of the printing machine as the cover is opened.

17 Claims, 5 Drawing Sheets

AUTOMATIC CAMMING OF A DEVELOPER MODULE

BACKGROUND OF THE INVENTION

This invention relates to electrostatographic reproduction machines, and more particularly to a process cartridge for use in electrostatographic reproduction machines. Specifically this invention relates to such a cartridge with automatic camming of a developer module.

Generally, the process of electrostatographic reproduction, as practiced in electrostatographic reproduction machines, includes charging a photo-conductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. A two component and single component developer materials are commonly used. A typical two-component dry developer material has magnetic carrier granules with fusible toner particles adhering triboelectrically thereto. A single component dry developer material typically including toner particles only can also be used. The toner image formed by such development is subsequently transferred at a transfer station onto a copy sheet fed to such transfer station, and on which the toner particles image is then heated and permanently fused so as to form a "hardcopy" of the original image.

It is well known to provide a number of the elements and components, of an electrostatographic reproduction machine, in the form of a customer or user replaceable unit (CRU). Typically such units are each formed as a cartridge that can be inserted or removed from the machine frame by a customer or user. Reproduction machines such as copiers and printers ordinarily include consumable materials such as toner, volume limiting components such as a waste toner container, and life cycle limiting components such as a photoreceptor and a cleaning device. Because these elements of the copying machine or printer must be replaced frequently, they are more likely to be incorporated into a replaceable cartridge as above.

There are therefore various types and sizes of cartridges, varying from single machine element cartridges such as a toner cartridge, to all-in-one electrostatographic toner image forming and transfer process cartridges. The design, particularly of an all-in-one cartridge can be very costly and complicated by a need to optimize the life cycles of different elements, as well as to integrate all the included elements, while not undermining the image quality. This is particularly true for all-in-one process cartridges to be used in a family of compact electrostatographic reproduction machines having different volume capacities and elements having different life cycles.

The step of development or placing the toner particles in contact with the latent image on the photoconductor drum to form the developed image requires that the marking particles or toner be presented to the photoconductive drum. Typically, a donor roll or a roll including a stationary internal magnetic shaft with a rotatable aluminum steel positioned around the outer peripheral of the shaft is utilized to advance the marking particles toward the photoconductive drum.

The spacing between the developer roll and the photoconductive drum surface is important. Spacers placed on the developer roll are often used to ride against the photoconductive surface of the photoconductive drum to maintain an accurate distance between the developer roll and the photoconductive drum. To assure that the spacer remains in contact with the photoconductive surface of the photoconductive drum, preferably, the developer roll is pivotably positioned into contact with the photoconductive drum. A device, usually in the form of a spring, is used to urge the developer roll against the photoconductive drum.

Customer replaceable units (CRUs) which may also be known as cartridges, i.e., process cartridges, are intended to be removed and replaced by a fairly untrained operator of the copy or printing machine. The removal of the CRU and the replacement with a new CRU is intended to be a simple, easy task. Typically, CRU is replaced by first opening a cover or door and then sliding the CRU out of a cradle or location where the CRU fits within the machine. These CRUs are used to interact with the xerographic process and with the paper within the machine. Therefore, CRUs frequently need to be engaged into an operating position within the machine during the installation of the CRU. The CRU thus typically is slid or placed into the opening where it fits and then positioned into an operating arrangement within the printing machine. Typically, the used CRU must first be separated from the components with which it engages and then withdrawn from the printing machine. Similarly, a new replacement CRU must first be inserted into the machine and then interconnected with the operating portions of the printing machine. Such a typical CRU is in the form of a process cartridge.

The process cartridge includes a number of components which have been selected for periodic replacement and typically include the marking particles as well as other components. The process cartridge typically includes the developer roll which is in proximity to the photoconductive drum. The magnetic roll assembly must first be separated from the photoconductive drum and then the process cartridge may be removed from the printing machine. If the magnetic roll is not separated from the photoconductive drum prior to removal, great damage can occur to the photoconductive surface of the drum.

Attempts have been made to provide for the separation of the magnetic roll from the photoconductive drum prior to removal. For example, cranks and levers or knobs are typically used to separate the photoconductive drum from the developer roll within the process cartridge prior to the removal of the process cartridge. The current use of a lever or knob has at least two significant disadvantages. The first of these is that if the lever or knob fails to be properly utilized, the drum may be damaged by the removal of the process cartridge. An additional problem is that the operation of the lever or knob to separate the process cartridge from the drum makes the process cartridge change more time consuming, more difficult, and may require a trained operator to replace.

The present invention is intended to alleviate at least some of the aforementioned problems.

The following disclosures may be relevant to various aspects of the present invention:

U.S. Pat. No. 5,819,139

Patentee: Harlan, et al.

Issue Date: Oct. 6, 1998

U.S. Pat. No. 5,809,375

Patentee: Owens, Jr., et al.

Issue Date: Sep. 15, 1998

U.S. Pat. No. 5,787,322

Patentee: Sass, et al.

Issue Date: Jul. 28, 1998

U.S. Pat. No. 5,774,766

Patentee: Karakama, et al.

Issue Date: Jun. 30, 1998

U.S. Pat. No. 5,749,027

Patentee: Ikemoto, et al.

Issue Date: May 5, 1998

U.S. Pat. No. 5,666,608

Patentee: Christensen

Issue Date: Sep. 9, 1997

U.S. Pat. No. 5,485,244

Patentee: Gotoda, et al.

Issue Date: Jan. 16, 1996

U.S. Pat. No. 5,398,098

Patentee: Fukunaga, et al.

Issue Date: Mar. 14, 1995

U.S. Pat. No. 5,126,789

Patentee: Fukuchi, et al.

Issue Date: Jun. 30, 1992

U.S. Pat. No. 5,119,134

Patentee: Hanada et al.

Issue Date: Jun. 2, 1992

U.S. Pat. No. 5,819,139 discloses a slidable subsystem for use in a printing machine 1. The subsystem includes a body slidably mounted to the printing machine, a handle connected to the body, and a lever. The lever is operably associated with the body. The lever selectively secures the body to the printing machine. The lever is movable into a first relaxed position and a second secured position. The lever cooperates with said handle to permit the handle to be extended forwardly when the lever is in a relaxed position.

U.S. Pat. No. 5,809,375 discloses a xerographic CRU (Customer Replaceable Unit) for an electrophotographic printing machine. The xerographic CRU has retaining features and cooperates with a drive module with certain retractable features that allow the insertion and removal of the CRU without causing damage to the photoreceptor and other critical subsystems. The unit further has many locating members for other subsystems so that critical tolerances are maintained. An interface with a single handle assembly retracts/unlocks and extends/locks the drive module and the associated CRU subsystems into an operative position. The CRU also has electrical and drive connections for the cleaning system, the charging system and transfer/detack.

U.S. Pat. No. 5,787,322 discloses a mechanism for selectively positioning a plurality of components in a printing machine is provided. The mechanism includes a lever for controlling the mechanism, a first linkage operably connecting the lever to a first component, and a second linkage operably connecting the lever to a second component, so as to simultaneously reposition the first component and the second component by actuating the lever.

U.S. Pat. No. 5,774,766 discloses a process cartridge detachably mountable to a main assembly of an electrophotographic image forming apparatus includes an electrophotographic photosensitive drum, a development roller for developing a latent image formed on the electrophotographic photosensitive drum, a toner accommodating portion for accommodating toner to be used by the development roller for development, a photosensitive drum frame for supporting the electrophotographic photosensitive drum, a development frame including the toner accommodating portion, and a support frame including a first toner leakage preventing member positioned at one longitudinal end of the development roller and a second toner leakage preventing member positioned at the other longitudinal end of the development roller. The development frame and the support frame are rotatably connected about a positioning member and, in this connected state, a portion of the development frame is welded to a portion of the support frame so that the development frame and the support frame are joined together.

U.S. Pat. No. 5,747,027 discloses an assembling method of a process cartridge detachably mountable to a main assembly of an image forming apparatus. The method includes a. preparing a drum frame to which an electrophotographic photosensitive drum is mounted; b. preparing a developing frame having a toner accommodating portion for accommodating toner for developing a latent image formed on the electrophotographic photosensitive drum and also having a developing device mounted thereto, for developing the latent image formed on the electrophotographic photosensitive drum, using toner accommodated in the toner accommodating portion; c. engaging a portion of the drum frame and a portion of the developing frame; d. coupling a coupling member with a portion where the drum frame and the developing frame are engaged to couple the drum frame and developing frame, wherein the drum frame and the developing frame are rotatable relative to each other about the coupling member; e. spring mounting process of mounting a compression spring to apply elastic force to the drum frame and the developing frame thus coupled.

U.S. Pat. No. 5,666,608 discloses a spacer apparatus for providing separation between a photoconductor drum and a charge roller in an electrophotographic printing system prior to first use includes a first and a second spacer member pivotally mounted to the shaft of the charge roller. Attached to the first and the second spacer members are, respectively, a first and a second spacer cam which contact the photoconductor drum in a region outside of the electrostatic latent image forming area of the photoconductor drum. Prior to the first rotation of the photoconductor drum, the first and second spacer cams maintain separation between the photoconductor drum and the charge roller. After the first rotation of the photoconductor drum, the first and second spacer cams rotate about the shaft of the charge roller and permit the charge roller to be engaged against the photoconductor drum by the compression springs.

U.S. Pat. No. 5,485,244 discloses an apparatus to attach or detach a process cartridge to or from a support member of an LED printer. An upper housing is angularly displaced and opened around a supporting position relative to a lower housing. As the upper housing is gradually opening relatively to the lower housing, the support member is angularly displaced around a connection position with the lower housing to be separated from the upper housing. Then, a used process cartridge can be detached from the support member and another new process cartridge can be attached thereto, thereby allowing such maintenance operation to be easily performed.

U.S. Pat. No. 5,398,098 discloses a forming apparatus of the present invention is provided with a waste-toner transport unit that is installed separately from a photoreceptor drum cartridge. The waste-toner transport unit is pivoted so that the photoreceptor drum cartridge is easily removed from a machine main body. This arrangement makes it possible to miniaturize the photoreceptor drum cartridge and to use the waste-toner transport unit repeatedly. In another image forming apparatus of the present invention, a developer-supplying container, a waste-toner container, and a waste-developer container for receiving excessive developer that has been overflown from the developer tank are integrally formed into a container unit. This arrangement makes it possible to reduce the volumes of the containers in accordance with the respective supplying quantities of developer. Further, a pressing mechanism is provided so that upon replacing the container unit, the developer tank is brought apart from and close to the photoreceptor drum simultaneously with the pivotal movement of the container unit. This arrangement makes it possible to reduce the number of steps that are taken in the replacing operation as well as to prevent misoperations such as caused by negligence of duty in pressing the developer tank toward the photoreceptor.

U.S. Pat. No. 5,126,789 discloses an image forming apparatus having a cassette for containing copy sheets, the cassette being releasable responsive to the opening of an upper cover to cover an upper portion of the apparatus. The image forming apparatus may be further provided with a cartridge for carrying at least one of an image carrying body, developing units and a cleaning unit, and the cartridge is also released responsive to the opening of the upper cover of the image forming apparatus.

U.S. Pat. No. 5,119,134 discloses a color image forming apparatus wherein a belt-shaped image retainer faces an image forming device. The image forming device includes a charging device, exposure device and a plurality of developing devices which are juxtaposed with each other. The belt-shaped image retainer is in the form of a cartridge which is mounted removably in the apparatus body. The cartridge has a closeable cover divided into several sections which are arranged at the positions facing the image device. The belt-shaped image retainer has a transversely movable shutter member for protecting spaced apart surface portions of the image retainer which would be otherwise exposed when the upper casing of the apparatus body is opened or when the image retainer is removed from the upper casing, by moving the shutter member transversely to cover the spaced apart exposed surface portions of the image retainer.

SUMMARY OF THE INVENTION

In accordance with one aspect of the present invention, there is provided a mechanism for use in a printing machine having a cover for covering a portion of the printing machine. The mechanism is operably associated with the cover and with the portion of the printing machine. The mechanism is adapted so as to move the portion of the printing machine as the cover is opened.

In accordance with another aspect of the present invention, there is provided a development unit for use in a printing machine having a cover for covering a portion of the development unit. The development unit includes a development housing movably mounted to the printing machine and a member. The member is movably mounted to the development housing for advancing the marking particles toward the latent image. The development unit also includes a mechanism which is operably associated with the development housing and the cover so that said member moves away from the latent image as the cover is opened.

In accordance with yet another aspect of the present invention, there is provided a printing machine having a cover for covering a portion of the printing machine. The printing machine includes a mechanism operably associated with the cover and with the portion of the printing machine. The mechanism is adapted so as to move the portion of the printing machine as the cover is opened.

In accordance with a further aspect of the present invention, there is provided a mechanism for use in a printing machine. The mechanism includes a first member defining a first member surface and a second member. The second member is operably associated with the first member, the second member defines a second member surface. The first member moves away from the second member when the first member surface slides with respect to the second member surface in a first direction. The first member moves toward the second member when the first member surface slides with respect to the second member surface in a second direction opposed to the first direction.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 2:
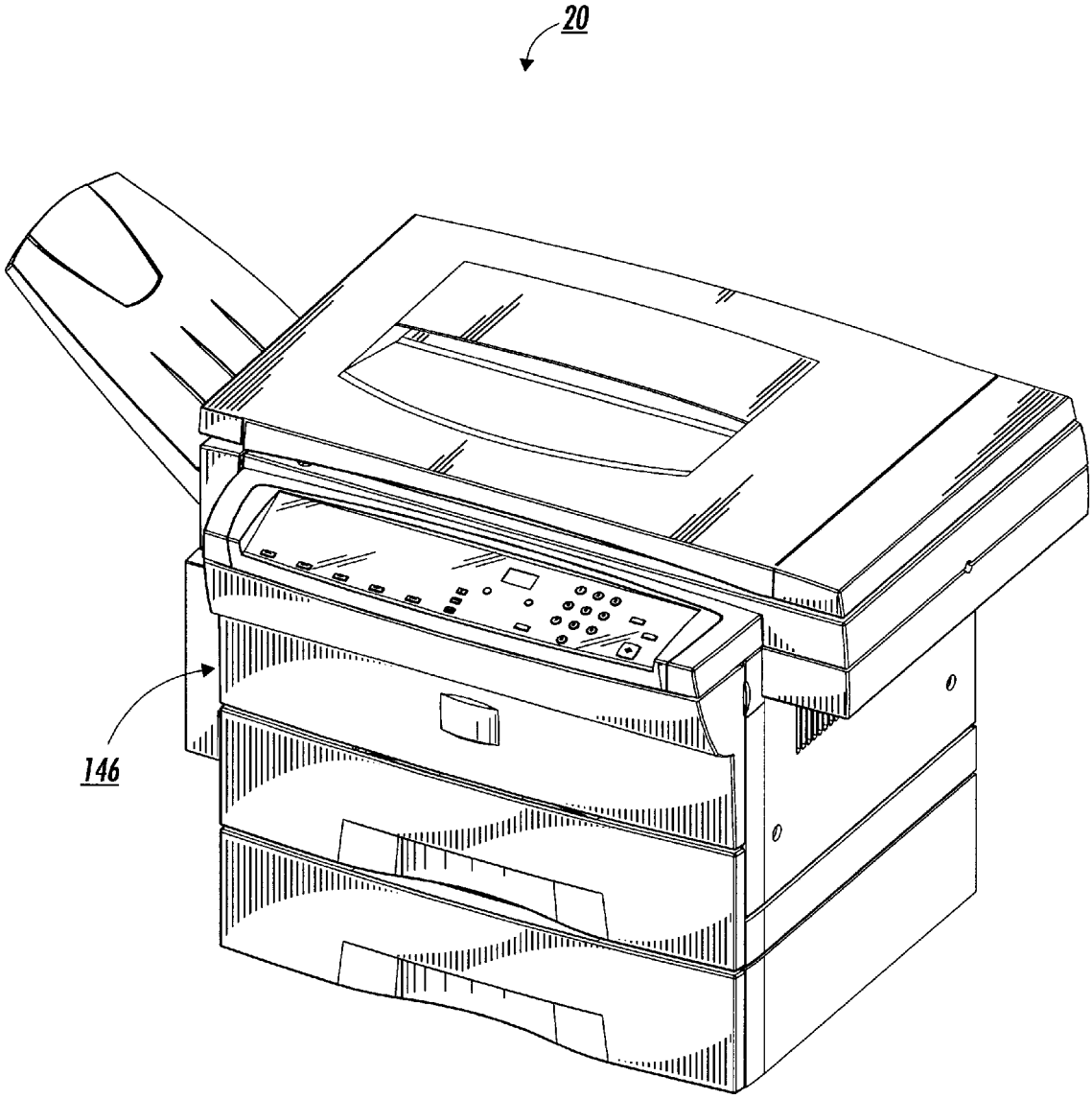
FIG. 2 is a perspective view of the machine of FIG. 1.
Figure 3:
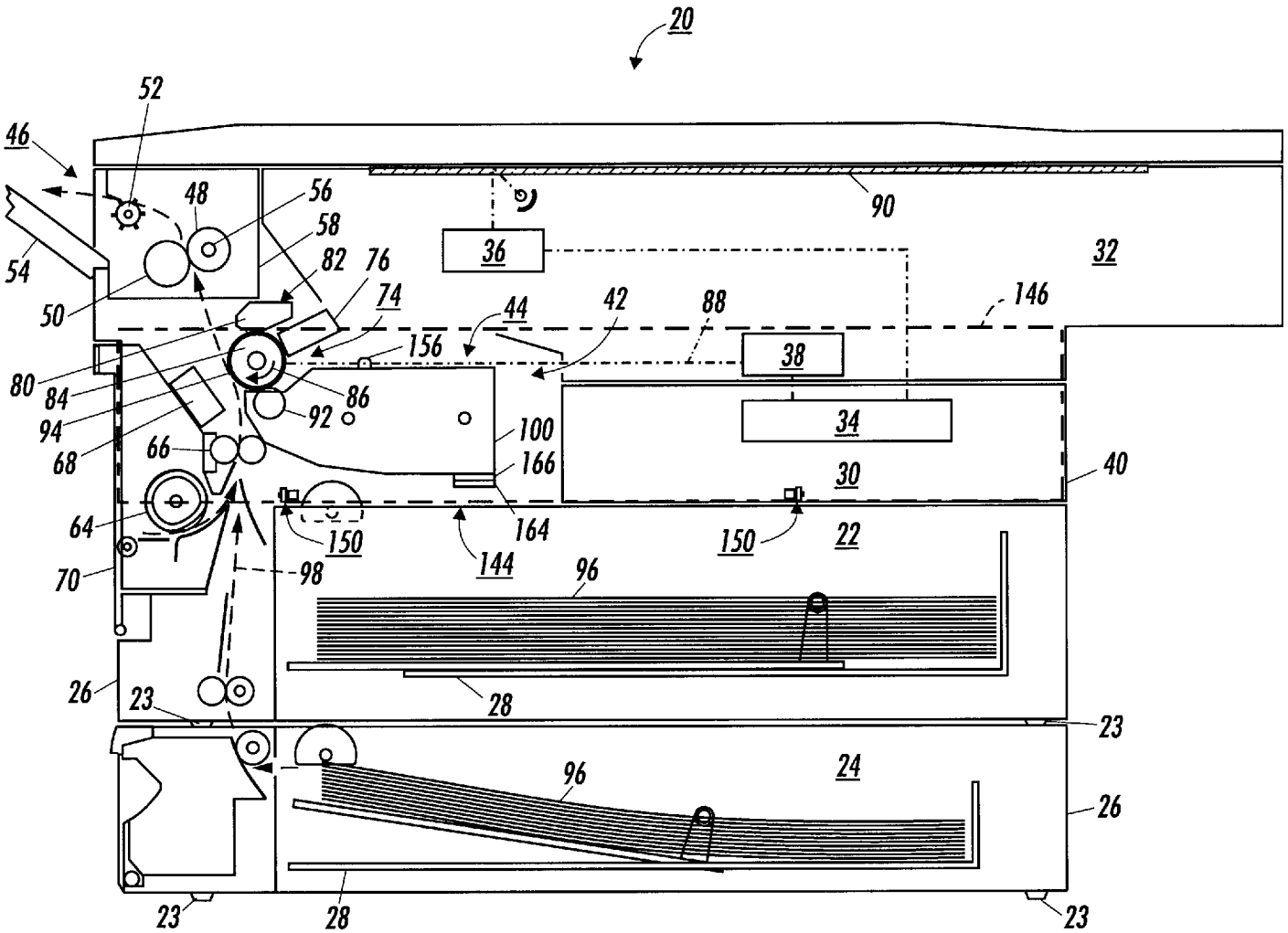
FIG. 3 is an elevational view of an exemplary electrostatographic reproduction machine including the automatic camming of the developer module in accordance with the present invention.

Referring now to FIGS. 2 and 3, there is illustrated a frameless exemplary compact electrostatographic reproduction machine 20 including separately framed mutually aligning modules. The compact machine 20 may be frameless, meaning that it does not have a separate machine frame to which electrostatographic process subsystems are assembled, aligned to the frame, and then aligned relative to one another as is typically the case in conventional machines. Instead, the architecture of the compact machine 20 may include a number of individually framed, and mutually aligning machine modules that variously include pre-aligned electrostatographic active process subsystems.

As shown, the frameless machine 20 may include a framed copy sheet input module (CIM) 22. Preferably, the machine 20 includes a pair of copy sheet input modules, a main or primary module the CIM 22, and an auxiliary module the (ACIM) 24, each of which has a set of legs 23 that can support the machine 20 on a surface, therefore suitably enabling each CIM 22, 24 to form a base of the machine 20. As also shown, each copy sheet input module (CIM, ACIM) includes a module frame 26 and a copy sheet stacking and lifting cassette tray assembly 28 that is slidably movable in and out relative to the module frame 26. When as preferred here, the machine 20 includes two copy sheet input modules, the very base module is considered the auxiliary module (the ACIM), and the top module which mounts and mutually aligns against the base module is considered the primary module (the CIM).

The machine 20 next includes a framed electronic control and power supply (ECS/PS) module 30, that as shown mounts onto, and is mutually aligned against the CIM 22 (which preferably is the top or only copy sheet input module). A framed latent image forming imager module 32 then mounts over and is mutually aligned against the ECS/PS module. The ECS/PS module 30 includes all controls and power supplies (not shown) for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. The ECS/PS module 30 also includes harnessless interconnect boards and inter-module connectors (not shown), that provide all power and logic paths to the rest of the machine modules. An interconnect board (PWB) (not shown) connects the ECS controller and power supply boards (not shown) to the inter-module connectors, as well as locates all of the connectors to the other modules in such a manner that their mating connectors would automatically plug into the ECS/PS module during the final assembly of the machine 20. The ECS/PS module 30 may include a module frame 40 to which the active components of the module as above are mounted, and which forms a covered portion of the machine 20, as well as locates, mutually aligns, and mounts to adjacent framed modules, such as the CIM 22 and the imager module 32.

The framed copy sheet input modules 22, 24, the ECS/PS module 30, and the imager module 32, as mounted above, define a cavity 42. The machine 20 may include a process cartridge module 44 that is insertably and removably mounted within the cavity 42, and in which it is mutually aligned with, and operatively connected to, the framed CIM, ECS/PS and imager modules 22, 30, 32.

As further shown, the machine 20 may include a framed fuser module 46, that is mounted above the process cartridge module 44, as well as adjacent an end of the imager module 32. The fuser module 46 includes a pair of fuser rolls 48, 50, and at least an exit roll 52 for moving an image carrying sheet through, and out of, the fuser module 46 into an output or exit tray 54. The fuser module also includes a heater lamp 56, temperature sensing means (not shown), paper path handling baffles (not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine 20 may include active components including a bypass feeder assembly 64, sheet registration rolls 66, toner image transfer and detack devices 68, and the fused image output or exit tray 54. The machine 20 may include drive coupling components and electrical connectors (not shown), and a module frame 70 to which the active components are mounted, and which forms a covered portion of the machine 20, as well as, locates, mutually aligns, and mounts to adjacent framed modules, such as the CIM 22, the process cartridge module 44, and the fuser module 46.

Referring again to FIG. 3, the CRU or process cartridge module 44 may optionally include a photoreceptor subassembly 74, a charging subassembly 76, developer housing 100 including a source of fresh developer material, a cleaning subassembly 80 for removing residual toner as waste toner from a surface of the photoreceptor, and a waste toner sump subassembly 82 for storing waste toner. The process cartridge module 44 importantly provides and includes supporting, locating and aligning structures, as well as driving components for the process cartridge module 44.

Still referring to FIG. 3, operation of an imaging cycle of the machine 20 using the process cartridge module 44 generally, can be briefly described as follows. Initially, a photoreceptor in the form of a photoconductive drum 84 of the customer replaceable unit (CRU) or process cartridge module 44, rotating in the direction of the arrow 86, is charged by the charging subassembly 76. The charged portion of the drum is then transported to an imaging/exposing light 88 from the ROS 38 which forms a latent image on the drum 84, corresponding to an image of a document positioned on a platen 90, via the imager module 32. It will also be understood that the imager module 32 can easily be changed from a digital scanning module to a light lens imaging module.

The portion of the drum 84 bearing a latent image is then rotated to the developer housing 100 where the latent image is developed with developer material such as with charged single component magnetic toner using a magnetic developer roller 92 of the process cartridge module 44. The developed image on the drum 84 is then rotated to a near vertical transfer point 94 where the toner image is transferred to a copy sheet substrate 96 fed from the CIM 22 or ACIM 22 along a copy sheet or substrate path 98. In this case, the detack device 68 of the door module 60 is provided for charging the back of the copy sheet substrate (not shown) at the transfer point 94, in order to attract the charged toner image from the photoconductive drum 84 onto the copy sheet substrate.

The copy sheet substrate with the transferred toner image thereon, is then directed to the fuser module 46, where the heated fuser roll 48 and pressure roll 50 rotatably cooperate to heat, fuse and fix the toner image onto the copy sheet substrate. The copy sheet substrate then, as is well known, may be selectively transported to the output tray 54 or to another postfusing operation.

The portion of the drum 84 from which the developed toner image was transferred is then advanced to the cleaning subassembly 80 where residual toner and residual charge on the drum 84 are removed therefrom. The imaging cycle of the machine 20 using the drum 84 can then be repeated for forming and transferring another toner image as the cleaned portion again comes under the charging subassembly 76.

Figure 4:
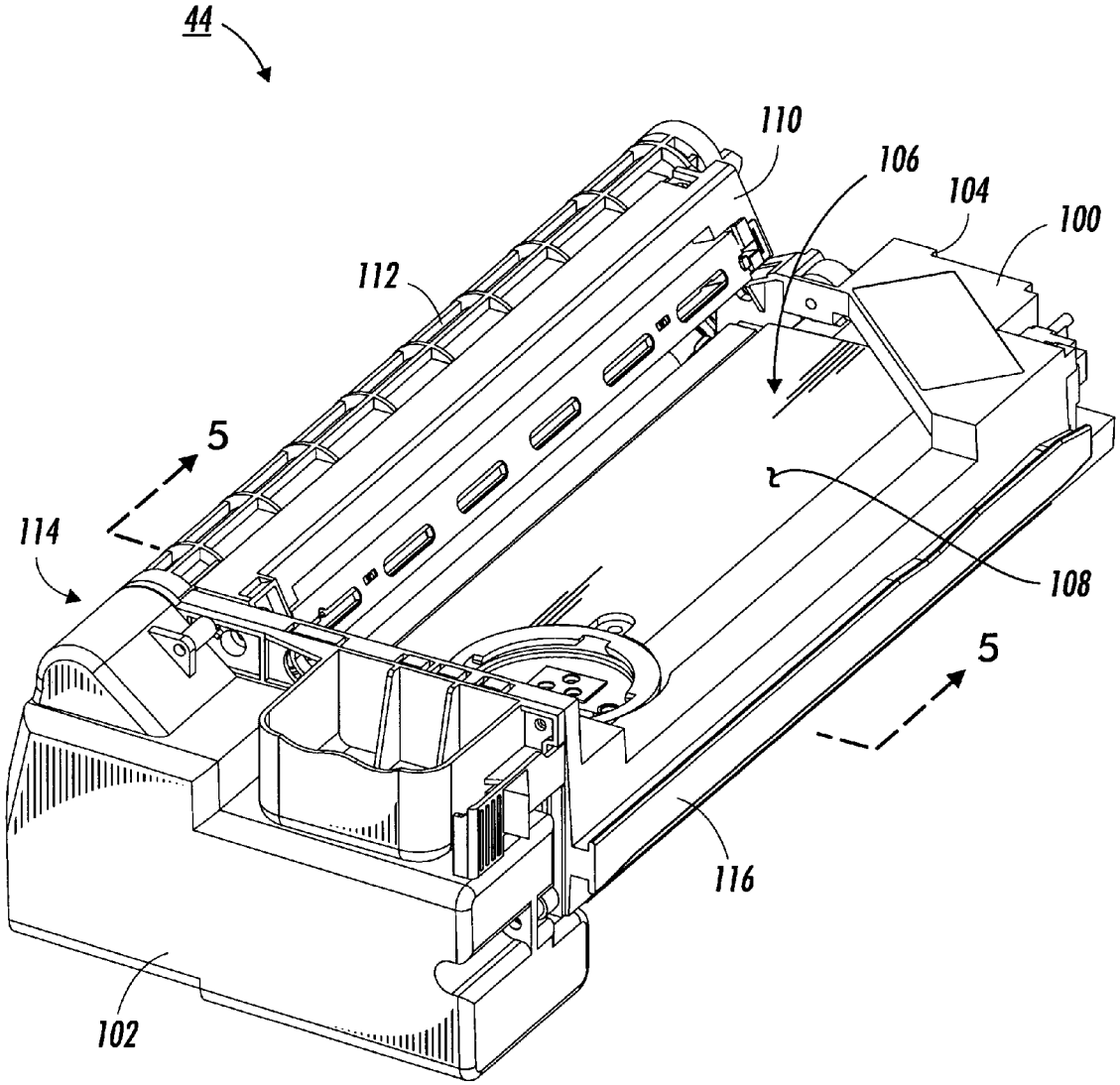
FIG. 4 is a top perspective view of the module housing of the CRU or process cartridge module of the machine of FIG. 3.

Referring now to FIG. 4, the process cartridge module 44 is illustrated. As shown, it includes a module housing 100 having a first side wall 102, a second and opposite side wall 104, a top wall 106 including a substantially horizontal portion 108 and a nearly vertical portion 110 defining a raised rear end 112 (rear as considered relative to the process cartridge 44 being inserted into the cavity 42). There is no rear wall, thus resulting in an open rear end 114 for mounting the photoreceptor subassembly 74. The trough shaped module housing also includes a front end wall 116 that connects at an angle to the top wall 106.

Figure 5:
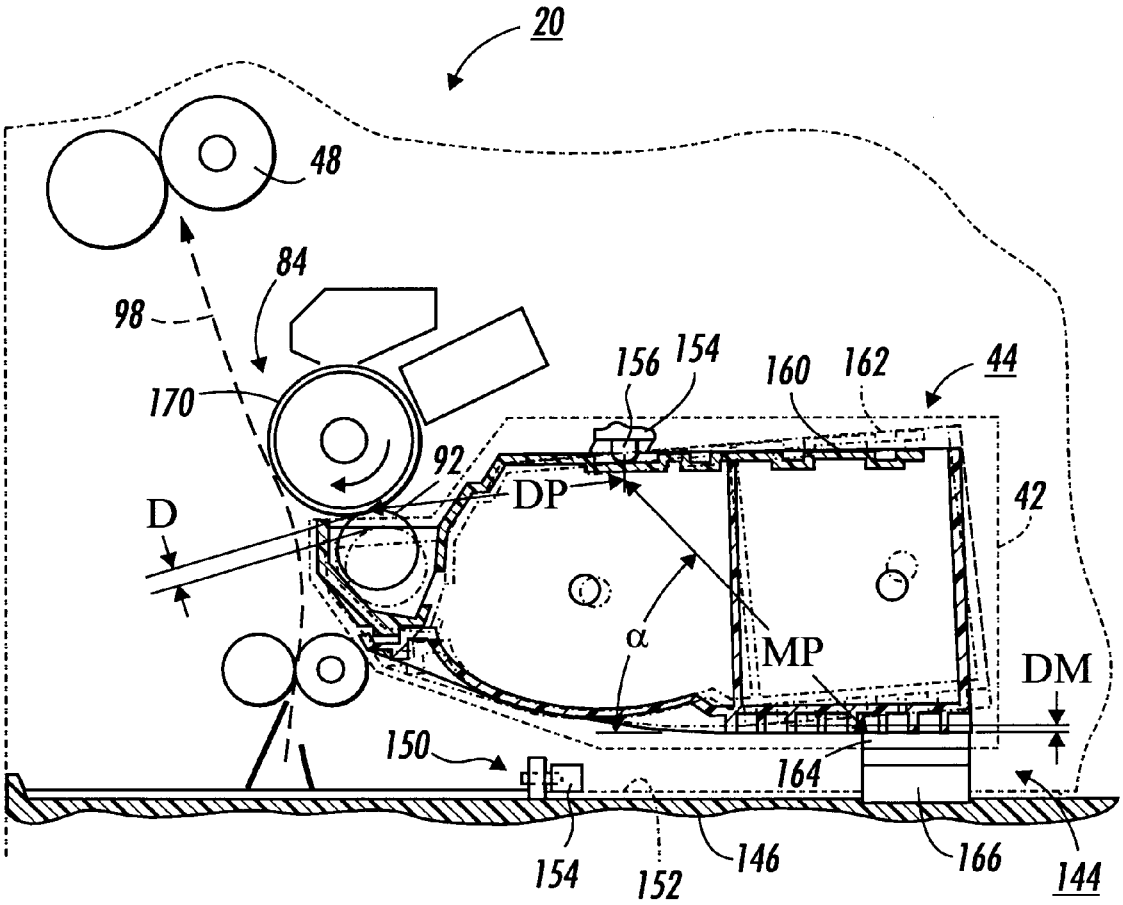
FIG. 5 is a partial vertical section (front-to-back) of the CRU or process cartridge module of the machine of FIG. 1 showing the automatic camming device of FIG. 1 in position with respect to the CRU.

Referring to FIGS. 2, 3 and 5, mechanism 144 according to the present invention is shown. The mechanism 144 shown in FIG. 3 is used in the printing machine 20. As shown in FIG. 2, the printing machine 20 includes a cover 146 for providing access to the mechanism 144 when opened and to provide protection from dust and to prevent inadvertent access to the internal workings of the printing machine 20. The cover 146 may for example be in the form of a removable cover or in the form of a portion of a drawer which may be slid outwardly from the machine 20. As shown in FIG. 5, the cover 146 is in the form of a door which as shown in FIG. 3 is hinged about hinges 150 connecting lower end 152 of the cover 146 to the frame 154 of the printing machine 20. The cover 146 is utilized to cover a portion of the printing machine. For example, as shown in FIG. 3, the cover 146 is utilized to cover the developer unit 44.

The mechanism 144 is operably associated with the cover 146 and may be directly or indirectly interconnected with each other. Further, the mechanism 144 is operably associated with portion 44 of the printing machine 20, for example developer unit 44. For example, the mechanism 144 may be directly or indirectly connected to the developer unit 44. The mechanism 144 is adapted so as to move the developer unit 44 of the printing machine 20 as the cover 146 is opened.

While the mechanism 144 may cooperate with the developer unit 44 to move the developer unit 44 in any direction which is advantageous for the removal of the developer unit 44 of the printing machine 20, for example, and as shown in FIG. 3, the developer unit 44 may be pivotally connected to the printing machine by pivot point 156.

As shown in FIG. 5, the mechanism 144 is utilized to move the developer unit 44 from first position 160 to second position 162. While as shown in FIG. 5 the mechanism 144 is used to rotate the developer unit 44, it should be appreciated that the mechanism 144 may be utilized to move the developer unit 44 in any desired direction.

Referring again to FIG. 5, the mechanism 144 is shown utilized for moving the developer unit 44. The mechanism 144 as shown in FIG. 5 includes a first member 164. The mechanism 144 also includes a second member 166 which is connected to the first member 164. As shown in FIG. 5, the second member 166 is further connected to the developer unit 44. Further, the second member 166 is connected to the cover 146. The first member 164 and the second member 166 are thus adapted so as to move the developer unit 44 of the printing machine 20 as the cover 146 is opened.

To assist in removing the developer housing 100 from the printing machine 20, the mechanism 144 is utilized to rotate the developer housing 100 about pivot point 156 from first position 160 as shown in solid to second position 162 as shown in phantom. When the developer housing 100 is in second position 162, the magnetic roller 92 is spaced a distance D from the photoconductive surface 170 of the photoreceptor drum 84. The distance D may be as little as 0.05 inches to as much as one inch or more with a distance D of around 0.1 to 0.3 inches being preferred.

Figure 1:
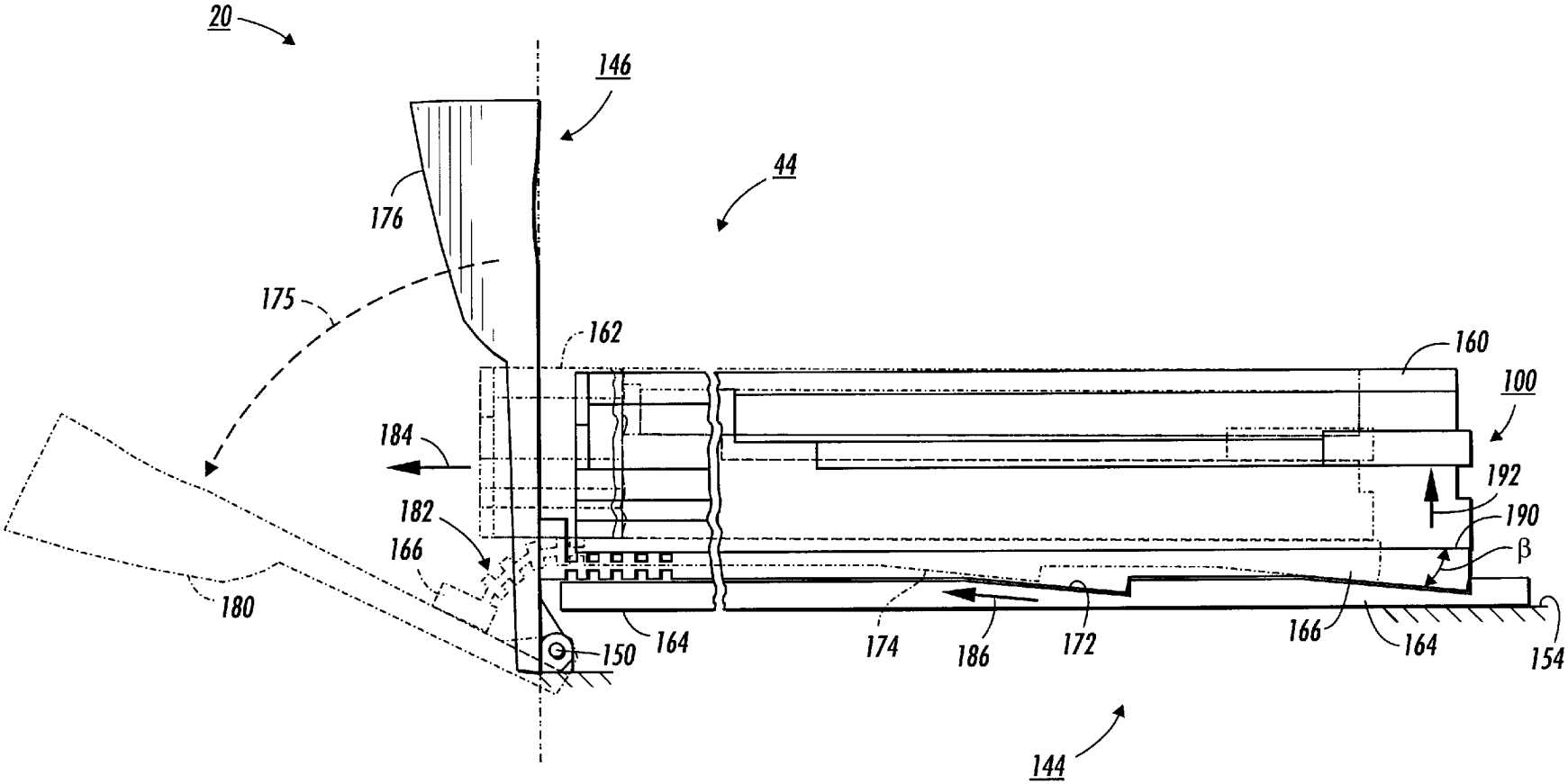
FIG. 1 is a side view, partially in section of an embodiment of an automatic camming device according to the present invention.

While the mechanism 144 may have any suitable shape and may for example be in the form of a linkage includes levers or be in the form of an electromechanical device such as a motor or solenoid, preferably and for simplicity, as shown in FIG. 1, the second member 166 is in slidable contact with the first member 164 of the mechanism 144.

Preferably, and as shown in FIG. 1, the first member 164 of the mechanism 144 includes a first member surface 172. Also, the second member 166 preferably includes a second member surface 174. The second member surface 174 is preferably in sliding contact with the first member surface 172 of the first member 164.

Preferably, and as shown in FIG. 1, the first member 164 is fixedly secured to the printing machine 20. For example, and as shown in FIG. 1, the first member 164 may be fixedly secured to frame 154. It should be appreciated however, that the first member 164 may be integral to the frame 154.

As shown in FIG. 1, the second member 166 is preferably secured to the door 146. The second member 166 is preferably positioned between the first member 164 and the developer housing 100. As shown in FIG. 1, the second member 166 is utilized to separate the developer housing 100 from the first member 164 as the door 146 is opened. When an operator wishes to remove a used developer unit or process cartridge 44 from the printing machine 20, the door 146 is first rotated downwardly in the direction of arrow 175 such that the door moves from door first position 176 shown in solid to door opened position 180 shown in phantom.

The second member 166 may be connected to the door 146 in any suitable fashion. For example, the second member 166 may include a connecting member (not shown) which is positioned between the door 146 and the second member 166. As shown in FIG. 1, the second member 166 is directly connected to the door 146. The second member 166 may be connected to the door 146 in any suitable fashion. For example, the second member 166 may be pivotally connected to the door 146. A pivotal connection of the second member 166 to the door 146 may permit the use of a solid rigid second member.

For simplicity, and as shown FIG. 1, the second member 166 may be fixedly connected to the door 146. The second member 166 may be connected to the door 146 by fasteners, by welding, or as shown in FIG. 1, be glued to the door 146. To permit the pivoting of the door 146 while connecting the second member 166 to the door 146, the second member 166 may be pliable or flexible and may include restricted areas with reduced cross section for example, living hinges 182. The living hinges 182 permit the portion of the second member 166 directly connected to the door 146 to rotate with the door while permitting the portion of the second member 166 which is in contact with the first member 164 to move in a linear direction.

As the door 146 moves in a rotating manner in the direction of arrow 175, the portion of the second member 166 attached to the door 146 moves in the direction of arrow 184. As the second member 166 moves in the direction of arrow 184, the second member surface 174 moves in the direction of arrow 186 in sliding contact with the first member surface 172. The movement of the second member surface 174 along arrow 186 causes upper surface 190 of the second member 166 to move upwardly in the direction of arrow 192. The movement of upper surface 190 in the direction of arrow 192 causes the developer housing 100 to move from first position 160 shown in solid, to second position 162 shown in phantom.

Referring again to FIG. 5, as the door 146 is moved to the open position, the second member 166 causes the developer housing 100 to rotate to the second position 162 causing the magnetic roller 92 to separate from the photoconductive drum 84 permitting the easy removal of the developer housing 100 from the printing machine 20. It should be appreciated that the distance MP from the pivot point 156 to the second member 166, the angle $\alpha$ between the upper surface 190 of the second member 166 and the line between the pivot point 156 and the second member 166, the distance DP from the pivot point 156 to the transfer point 94, as well as, the vertical movement DM of the second member 166 affect the distance D that the magnetic roller 92 moves away from the photoconductive drum 84.

Referring again to FIG. 1, the second member surface 174 forms an angle $\beta$ between the upper surface 190 of the second member 166 and the second member surface 174. The angle $\beta$ is chosen to provide for sufficient movement of the developer housing 100 in the direction of arrow 192. For example, the angle $\beta$ can be 10 degrees to 60 degrees with approximately 30 degrees being preferred. For an angle $\beta$ of 30 degrees, a motion of the second member 166 in the direction of arrow 184 of one inch will represent a motion of the second member 166 in the direction of arrow 92 of approximately 0.577 inches.

The first member 164 may be made of any suitable, durable material. For example, the first member 164 may be a plastic or a metal. For simplicity and to reduce cost, the first member 164 may be integral with another part of the printing machine 20, i.e. the frame 154. If the frame 154 is made of a plastic for example, the frame 154 and the first member 164 may be made of a simple, durable and inexpensive plastic such as ABS or high impact polystyrene (HIPS).

The second member 166 may be made of any suitable, durable material and may be made of a plastic or a metal. If the second member 166 includes living hinges 182 as shown in FIG. 1, the second member 166 is preferably made of a flexible plastic. For example, the second member 166 may be made of a moldable plastic, for example, polypropylene.

By providing a mechanism operably associated with a cover and with a portion of the printing machine and adapted to move the portion of the printing machine as the cover is opened, a mechanism can be provided which assists in the removal of the portion of the printing machine during service and maintenance of the machine.

By providing a mechanism for a printing machine including a second member which is in slidable contact with a second member, such that the second member is adapted to move the portion of the printing machine as the cover is opened, a mechanism to assist the simple removal of the portion of the printing machine is provided.

By providing a mechanism to assist in the removal of a process cartridge from a printing machine including a member with an inclined surface which is attached to the cover of the printing machine and to the process cartridge, the process cartridge can be separated from the photoconductive drum to assist in removal of the process cartridge.

By providing a mechanism including a pair of members with inclined surfaces cooperating with each other, a mechanism can be provided which rotates the process cartridge away from the photoconductive drum as the door is opened to make removal of the process cartridge more simple and to preclude the damage of the photoconductive drum during removal of the process cartridge.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A mechanism for use in a printing machine having a cover for covering a portion of the printing machine, said mechanism being operably associated with the cover and with the portion of the printing machine, said mechanism adapted so as to move the portion of the printing machine as the cover is opened; wherein said mechanism comprises:

a first member operably associated with the cover; and a second member operably associated with said first member and operably associated with the portion of the printing machine, said first member and said second member adapted so as to move the portion of the printing machine as the cover is opened;

wherein said first member includes a surface thereof; and wherein said second member includes a surface thereof, the surface of said first member being in sliding contact with the surface of said second member.

2. A mechanism according to claim 1 wherein said first member separates the portion of the printing machine from said second member as the cover is opened.

3. A mechanism for use in a printing machine having a cover for covering a portion of the printing machine, said mechanism being operably associated with the cover and with the portion of the printing machine, said mechanism adapted so as to move the portion of the printing machine as the cover is opened; wherein said mechanism comprises:

a first member operably associated with the cover; and a second member operably associated with said first member and operably associated with the portion of the printing machine, said first member and said second member adapted so as to move the portion of the printing machine as the cover is opened;

wherein said second member is fixedly secured to the printing machine; and wherein said first member is secured to the cover and positioned between said second member and the portion of said machine.

4. A mechanism for use in a printing machine having a cover for covering a portion of the printing machine, said mechanism being operably associated with the cover and with the portion of the printing machine, said mechanism adapted so as to move the portion of the printing machine as the cover is opened; wherein said mechanism comprises:

a first member operably associated with the cover; and a second member operably associated with said first member and operably associated with the portion of the printing machine, said first member and said second member adapted so as to move the portion of the printing machine as the cover is opened;

wherein said first member defines a first member surface; and wherein said second member defines a second member surface, said first member moving away from said second member when said first member surface slides with respect to said second member surface in a first direction and said first member moving toward said second member when said first member surface slides with respect to said second member surface in a second direction opposed to the first direction.

5. A mechanism for use in a printing machine having a cover for covering a portion of the printing machine, said mechanism being operably associated with the cover and with the portion of the printing machine, said mechanism adapted so as to move the portion of the printing machine as the cover is opened; wherein said mechanism comprises:

a first member operably associated with the cover; and a second member operably associated with said first member and operably associated with the portion of the printing machine, said first member and said second member adapted so as to move the portion of the printing machine as the cover is opened;

wherein said cover comprises a door, said door pivotally mounted to said second member and said door pivotally mounted to said first member, whereby said first member moves with respect to said second member as said door is moved.

6. A development unit for use in a printing machine having a cover for covering a portion of the development unit, said development unit comprising:

a development housing movably mounted to said printing machine;

a member movably mounted to said development housing for advancing marking particles toward a latent image; and a mechanism operably associated with said development housing and to the cover, so that said member moves away from the latent image as the cover is opened; wherein said mechanism comprises:

a first member operably associated with the cover; and a second member operably associated with said first member and operably associated with said development housing, said first member and said second member adapted so as to move said development housing as the cover is opened;

wherein said first member includes a surface thereof; and wherein said second member includes a surface thereof, the surface of said first member being in sliding contact with the surface of said second member.

7. A development unit according to claim 6 wherein said development housing is pivotably mounted to said printing machine.

8. A development unit for use in a printing machine having a cover for covering a portion of the development unit, said development unit comprising:

a development housing movably mounted to said printing machine;

a member movably mounted to said development housing for advancing marking particles toward a latent image; and a mechanism operably associated with said development housing and to the cover, so that said member moves away from the latent image as the cover is opened; wherein said mechanism comprises:

a first member operably associated with the cover; and a second member operably associated with said first member and operably associated with said development housing, said first member and said second member adapted so as to move said development housing as the cover is opened;

wherein said second member is fixedly secured to the printing machine; and wherein said first member is secured to the cover and positioned between said second member and said development housing.

9. A development unit according to claim 8 wherein said first member separates said development housing from said second member as the cover is opened.

10. A development unit for use in a printing machine having a cover for covering a portion of the development unit, said development unit comprising:

a development housing movably mounted to said printing machine;

a member movably mounted to said development housing for advancing marking particles toward a latent image; and a mechanism operably associated with said development housing and to the cover, so that said member moves away from the latent image as the cover is opened; wherein said mechanism comprises:

a first member operably associated with the cover; and a second member operably associated with said first member and operably associated with said development housing, said first member and said second member adapted so as to move said development housing as the cover is opened;

wherein said first member defines a first member surface; and wherein said second member defines a second member surface, said first member moving away from said second member when said first member surface slides with respect to said second member surface in a first direction and said first member moving toward said second member when said first member surface slides with respect to said second member surface in a second direction opposed to the first direction.

11. A development unit for use in a printing machine having a cover for covering a portion of the development unit, said development unit comprising:

a development housing movably mounted to said printing machine;

a member movably mounted to said development housing for advancing marking particles toward a latent image; and a mechanism operably associated with said development housing and to the cover, so that said member moves away from the latent image as the cover is opened; wherein said mechanism comprises:

a first member operably associated with the cover; and a second member operably associated with said first member and operably associated with said development housing, said first member and said second member adapted so as to move said development housing as the cover is opened;

wherein said cover comprises a door, said door pivotally mounted to said second member and said door pivotally mounted to said first member, whereby said first member moves with respect to said second member as said door is moved.

12. A printing machine having a cover for covering a portion of the printing machine, said printing machine including a mechanism operably associated with the cover and with the portion of the printing machine, said mechanism adapted so as to move the portion of the printing machine as the cover is opened; wherein said mechanism comprises:

a first member operably associated with the cover; and a second member operably associated with said first member and operably associated with the portion of the printing machine, said first member and said second member adapted so as to move the portion of the printing machine as the cover is opened;

wherein said first member includes a surface thereof; and wherein said second member includes a surface thereof, the surface of said first member being in sliding contact with the surface of said second member.

13. A printing machine having a cover for covering a portion of the printing machine, said printing machine including a mechanism operably associated with the cover and with the portion of the printing machine, said mechanism adapted so as to move the portion of the printing machine as the cover is opened; wherein said mechanism comprises:

a first member operably associated with the cover; and a second member operably associated with said first member and operably associated with the portion of the printing machine, said first member and said second member adapted so as to move the portion of the printing machine as the cover is opened;

wherein said second member is fixedly secured to the printing machine; and wherein said first member is secured to the cover and positioned between said second member and the portion of said machine.

14. A printing machine according to claim 13 wherein said first member separates the portion of the printing machine from said second member as the cover is opened.

15. A printing machine having a cover for covering a portion of the printing machine, said printing machine including a mechanism operably associated with the cover and with the portion of the printing machine, said mechanism adapted so as to move the portion of the printing machine as the cover is opened; wherein said mechanism comprises:

a first member operably associated with the cover; and a second member operably associated with said first member and operably associated with the portion of the printing machine, said first member and said second member adapted so as to move the portion of the printing machine as the cover is opened;

wherein said first member defines a first member surface; and wherein said second member defines a second member surface, said first member moving away from said second member when said first member surface slides with respect to said second member surface in a first direction and said first member moving toward said second member when said first member surface slides with respect to said second member surface in a second direction opposed to the first direction.

16. A printing machine having a cover for covering a portion of the printing machine, said printing machine including a mechanism operably associated with the cover and with the portion of the printing machine, said mechanism adapted so as to move the portion of the printing machine as the cover is opened; wherein said mechanism comprises:

a first member operably associated with the cover; and a second member operably associated with said first member and operably associated with the portion of the printing machine, said first member and said second member adapted so as to move the portion of the printing machine as the cover is opened;

wherein said cover comprises a door, said door pivotally mounted to said second member and said door pivotally mounted to said first member, whereby said first member moves with respect to said second member as said door is moved.

17. A printing machine according to claim 16 wherein said first member defining a first member surface; and said second member operably associated with said first member, said second member defining a second member surface, said first member moving away from said second member when said first member surface slides with respect to said second member surface in a first direction and said first member moving toward said second member when said first member surface slides with respect to said second member surface in a second direction opposed to the first direction.

* * * * *